United States Patent [19]

Greene

[11] 4,037,821

[45] July 26, 1977

[54] TELESCOPING RETRACTOR

[75] Inventor: Frank E. Greene, Rolling Hills Estates, Calif.

[73] Assignee: The United States of America as represented by the Secretary of the Army, Washington, D.C.

[21] Appl. No.: 713,151

[22] Filed: Aug. 10, 1976

[51] Int. Cl.[2] ..... B66F 3/24

[52] U.S. Cl. ..... 254/93 R; 60/632; 60/638; 89/1.811

[58] Field of Search ..... 254/93 R, 93 M; 60/632, 60/638; 89/1.811

[56] References Cited

U.S. PATENT DOCUMENTS 3,888,085 6/1975 Larsonneur ..... 60/638

FOREIGN PATENT DOCUMENTS 1,109,566 7/1954 France ..... 60/632

41,216 11/1965 Germany ..... 254/93 R

*Primary Examiner*—Robert C. Watson

*Attorney, Agent, or Firm*—William G. Gapcynski; Lawrence A. Neureither; Harold W. Hilton

[57] ABSTRACT

A telescoping retractor comprised of a two stage cylinder assembly actuated by an electroexplosive power cartridge. A pair of cylinders are mounted in concentric relation. A piston rod is carried in the inner cylinder. The power cartridge produces the gas which sequentially retracts the outer cylinder, the inner cylinder and then the piston which is secured to the structure to be retracted.

1 Claim, 2 Drawing Figures

TELESCOPING RETRACTOR

BACKGROUND OF THE INVENTION

Prior to launch of some missiles, a umbilical connector connects the missile to the ground support equipment. It is necessary to extract the umbilical fittings from the missile immediately prior to launch. The device of the present invention retracts the umbilical in the desired time. The retraction device provides controlled retraction velocity, straight line pull-out of the umbilical connector. The device is telescoping to provide the capability to retract and stow umbilicals within limited space prior to or at the missile launch order.

SUMMARY OF THE INVENTION

A umbilical retraction apparatus having an outer, first stage, cylinder, a second stage cylinder carried concentrically in the outer cylinder and a piston and piston rod carried in the second stage cylinder. An inlet port is provided in the outer first stage cylinder to which power cartridge is attached. A second inlet port is provided in the second stage cylinder to direct gases therein against the piston responsive to retraction of the first stage cylinder. A shock absorber disk is provided within the first stage cylinder to reduce impact force during retraction.

DESCRIPTION OF THE PREFERRED EMBODIMENT

Figure 1:
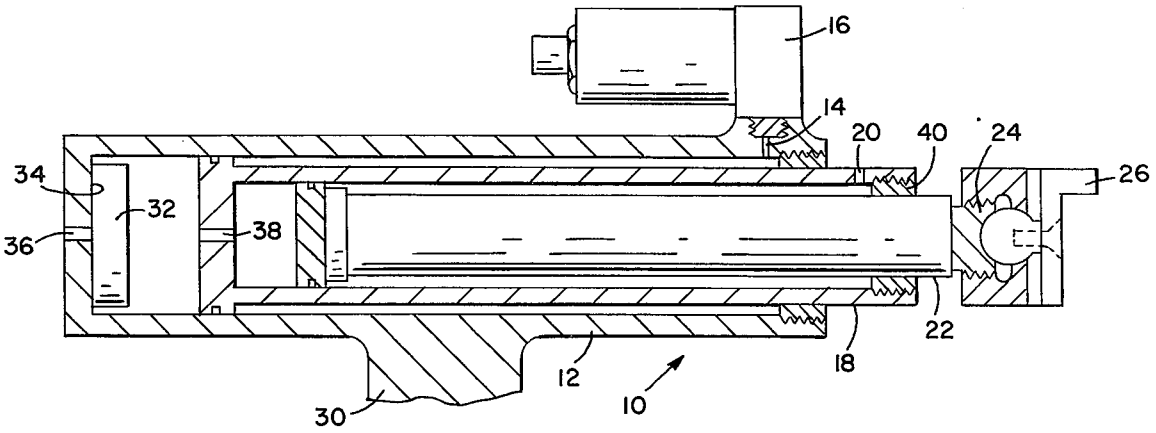
FIG. 1 is an elevational sectional view of the retraction device of the present invention, in retracted position.
Figure 2:
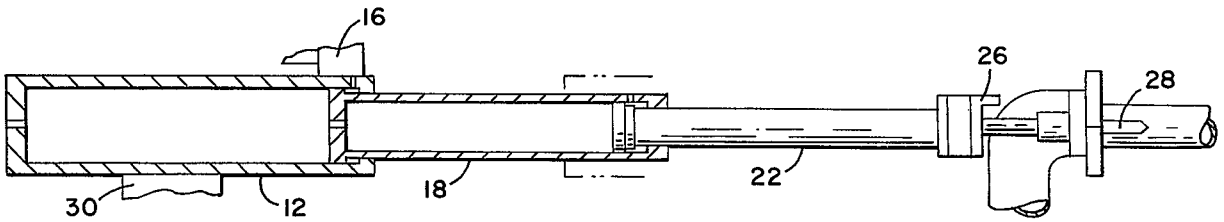
FIG. 2 is a diagrammatic view of the retraction device in extended position.

As seen in FIG. 1 the telescoping retractor 10 includes an outer first stage cylinder 12 having an inlet 14 therein having a power cartridge 16 secured therein. A second stage cylinder 18 is slidably mounted in the first stage cylinder and is provided with an inlet port 20 therein. A piston rod 22 is slidably carried in second stage cylinder 18 and has its distal end 24 secured to a retractor beam 26 which is in turn secured to the umbilical 28 (FIG. 2). A self aligning mount 30 is secured to the outer cylinder. A shock absorbing disk 32 is carried in the base 34 of cylinder 12. Air ports 36 and 38 are respectively provided in cylinders 12 and 18. A plug 40 seals cylinder 18.

Retraction is provided by remotely firing the power cartridge to produce gas which is directed in port 14 and causes cylinder 18 to retract. When cylinder 18 is completely retracted to port 20 therein is aligned with inlet port 14 causing piston rod 22 to retract. The shock absorber 32 reduces impact during retraction. Trapped air within the cylinders is exhausted through ports 36 and 38.

I claim:

1. A telescoping retraction device for rapidly withdrawing an umbilical connector from a missile comprising:

a. an outer cylinder having a first inlet port therein;

b. an inner cylinder slidably carried in said outer cylinder, said inner cylinder having a second inlet port therein;

c. a piston slidably carried in said inner cylinder, and a piston rod having a first end secured to said piston and a second end secured to said umbilical connector;

d. a power cartridge for generating a source of gas and for directing gas in said first inlet port to retract said inner cylinder for alignment of said second inlet port with said first inlet port whereby gas is directed against said piston for movement of said first object from said second object; and, shock absorbing means carried in the base of said outer cylinder.

* * * * *